US005816226A

United States Patent [19]

Jernigan et al.

[11] Patent Number: 5,816,226

[45] Date of Patent: Oct. 6, 1998

[54] IN-LINE FUEL TREATMENT DEVICE

[76] Inventors: Carl L. Jernigan, 1242 N. US 421; Timothy H. Jernigan, Rte. 1, Box 118, both of Lillington, N.C. 27546; Thomas G. Wood, Sr., 610 S. Elm Ave., Dunn, N.C. 28334

[21] Appl. No.: 890,568

[22] Filed: Jul. 9, 1997

[51] Int. Cl.[6] ..... F02M 27/04

[52] U.S. Cl. ..... 123/538

[58] Field of Search ..... 123/538, 536, 123/537; 210/222, 695

[56] References Cited

U.S. PATENT DOCUMENTS

| | | | |
|---|---|---|---|
| 2,632,296 | 3/1953 | Houdry . | |
| 2,926,276 | 2/1960 | Moriya et al. . | |
| 3,635,200 | 1/1972 | Rundell et al. | 123/538 |
| 4,572,145 | 2/1986 | Mitchell et al. . | |
| 4,711,271 | 12/1987 | Weisenbarger et al. | 123/538 |
| 4,715,325 | 12/1987 | Walker . | |
| 4,930,483 | 6/1990 | Jones . | |
| 5,044,346 | 9/1991 | Tada et al. . | |
| 5,048,499 | 9/1991 | Daywalt . | |
| 5,076,246 | 12/1991 | Onyszuk . | |
| 5,154,143 | 10/1992 | MacGregor . | |
| 5,167,782 | 12/1992 | Marlow . | |
| 5,305,725 | 4/1994 | Marlow . | |
| 5,342,586 | 8/1994 | Park . | |
| 5,524,594 | 6/1996 | D'Alessandro . | |
| 5,558,765 | 9/1996 | Twardzik | 123/538 |

*Primary Examiner*—Marguerite McMahon
*Attorney, Agent, or Firm*—Rosenthal & Putterman

[57] ABSTRACT

An in-line fuel treatment device improves fuel efficiency and decreases the quantity of harmful gases produced as the result of combustion. The device comprises an elongate hollow tube having an inlet end and an outlet end and is adapted to be connected in-line with the fuel line proximate the apparatus fuel intake. A plurality of magnets are positioned proximate the outer surface of the tube and a non-sacrificial catalyst is positioned within the tube. In a preferred embodiment, the catalyst is a naturally occurring silica in the form of quartz crystals.

11 Claims, 3 Drawing Sheets

IN-LINE FUEL TREATMENT DEVICE

FIELD OF THE INVENTION

This invention relates generally to the field of devices used to treat liquid fossil fuels prior to their entering a combustion engine or other fuel fired device in order to enhance the combustion thereof. More particularly, the fuel is treated with both magnetic fields and a catalyst.

BACKGROUND OF THE INVENTION

It is well known that hydrocarbon or fossil fuels can be treated to improve combustion efficiency and to reduce harmful exhaust emissions. For example, U.S. Pat. No. 4,572,145 to Mitchell et al. employs a magnet which is oriented so that its South pole is adjacent the fuel line and its North pole is spaced apart from the fuel line. The magnet is embedded in a U-Shaped body of non-magnetic material which is adapted to fit over the fuel line.

U.S. Pat. No. 5,305,725 to Marlow discloses another in-line device wherein the fuel contacts metals having standard reduction potentials of differing polarity. The metals are work hardened to produce slip bands and stria at the surface of the metals.

U.S. Pat. No. 5,154,153 discloses an in-line device wherein the fuel is passed across and between metallic surfaces that polarize the fuel and temporarily impart an electrostatic charge thereto.

Notwithstanding the foregoing, devices of this type have not been widely adopted by automobile manufacturers or by the driving public as an after-market device. This is because the prior art devices produce only marginal increases in fuel efficiency, on the order of tenths of a mile per gallon (for passenger automobiles). Furthermore, even when fuel efficiency is increased, the prior art devices fail to produce any decrease in engine emission gasses. Similarly, when emission gases are reduced, fuel efficiency is not significantly enhanced.

In view of the foregoing, it is an object of the present invention to provide a fuel treatment device which overcomes the drawbacks and deficiencies of the prior art.

Another object of the present invention is to provide a fuel treatment device which is simple and easy to install.

Yet another object of the present invention is to provide a fuel treatment device which is inexpensive.

A further object of the present invention is to provide a fuel treatment device which improves fuel efficiency and decreases combustion emissions.

SUMMARY OF THE INVENTION

In accordance with the present invention, there is provided a device for treating liquid and gaseous fossil fuels which are burned in a combustion engine or other combustion device. The device comprises an elongate hollow tube having an inlet end and an outlet end and is adapted to be connected in-line with the engine fuel line proximate the engine fuel intake. A plurality of magnets are positioned proximate the outer surface of the tube and a non-sacrificial catalyst is positioned within the tube. In a preferred embodiment of the invention, the catalyst is a naturally occurring silica in the form of quartz crystals.

BRIEF DESCRIPTION OF THE DRAWINGS

Some of the objects of the invention having been stated, other objects will appear as the description proceeds when taken in connection with the accompanying drawings in which.

DETAILED DESCRIPTION OF THE PREFERRED EMBODIMENTS

While the present invention will be described more fully hereinafter, it is to be understood at the outset that persons of skill in the art may modify the invention herein described while still achieving the favorable results of this invention. Accordingly, the description which follows is to be understood and being a broad teaching disclosure directed to persons of skill in the appropriate arts, and not as limiting upon the present invention.

Figure 1:
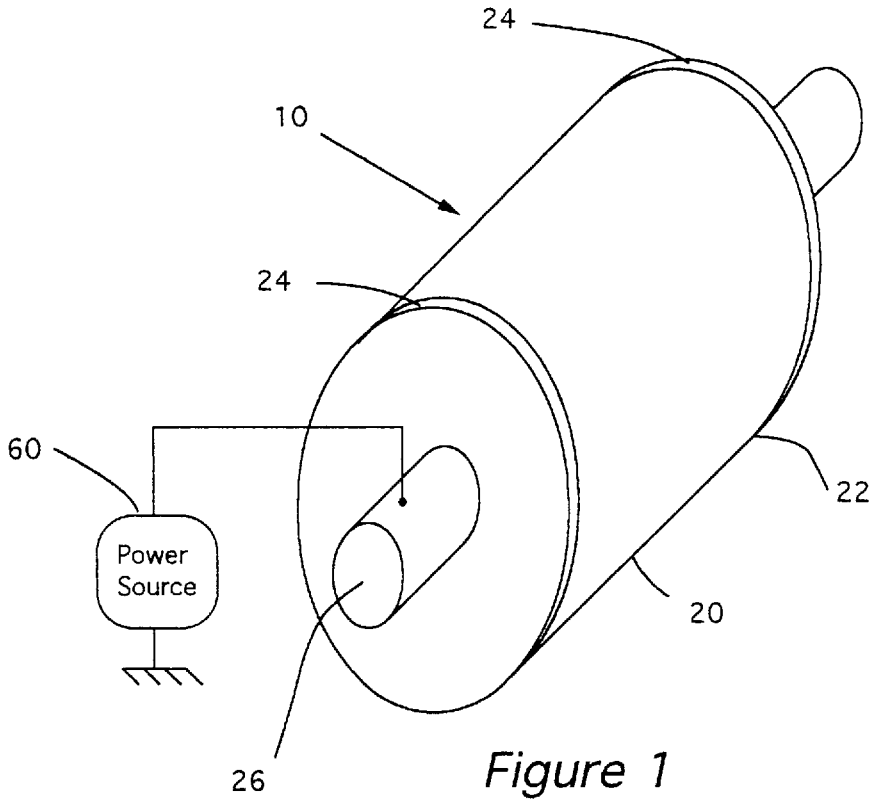
FIG. 1 is a perspective view of the fuel treatment device according to the present invention.

Referring now to the drawings, and particularly to FIG. 1, the fuel treatment device according to the present invention is generally indicated at 10 and comprises, in its basic form, a housing 20, a plurality of magnets 30, and a non-sacrificial catalyst means 40.

As illustrated in FIG. 1 the housing 20 is a cylindrical body which defines a cavity in which the functional portion of the device is positioned. The housing comprises a cylindrical tube 22 having end caps 24 at each end. The housing 20 is fabricated out of polyvinylchloride (PVC) pipe of an appropriate diameter. The housing 20 may be fabricated from any suitable material, but is preferably non-conducting. Located in the center of each end cap is an opening through which a tube or pipe 26 extends. The pipe 26 has an inlet end and an outlet end and is fabricated from any suitable material, preferably a stainless steel pipe and is threaded at each end (not shown) so that it may be connected by appropriate means in-line with the engine fuel line. In the prototype that was constructed, a stainless steel schedule forty pipe was employed.

Figure 2:
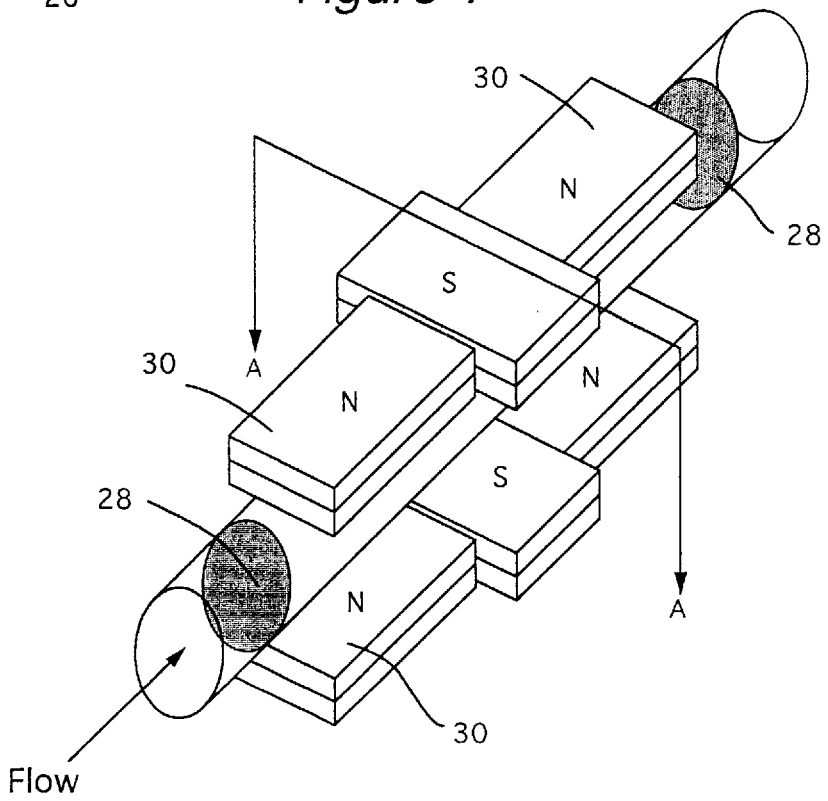
FIG. 2 is a perspective view of the portion of the fuel treatment device according to the present invention and illustrating the arrangement of the magnets.
Figure 3:
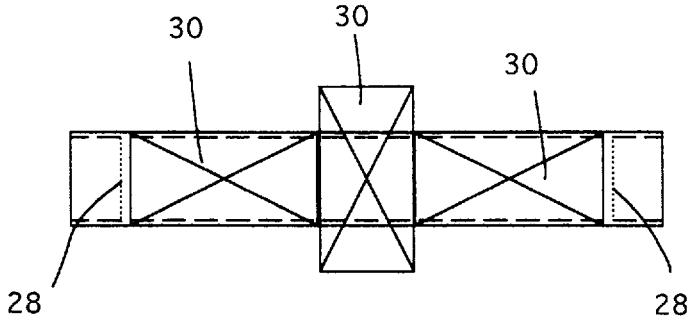
FIG. 3 is a plan view of the fuel treatment device according to the present invention.
Figure 4:
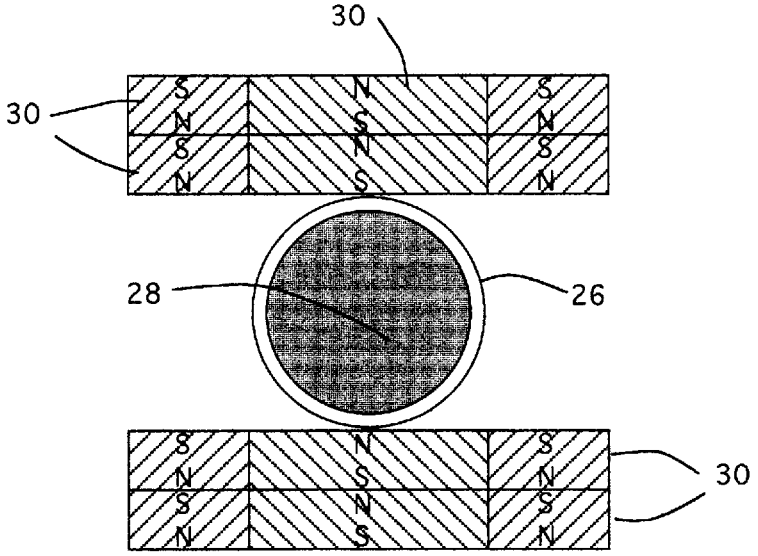
FIG. 4 is an end view of the fuel treatment device according to the present invention.

A plurality of magnets 30 are positioned proximate the outer surface of the pipe. The magnets 30 are mounted about the outer periphery of the pipe 26 as best illustrated in FIG. 2 and are mounted on opposite sides of the pipe in an alternatingly parallel and perpendicular configuration relative to the longitudinal axis of the pipe. It will be noted that the number and strength of magnets will vary with the type of fuel being burned as well as the fuel flow rate. In the prototypes that were constructed, a one half inch diameter pipe 26 and ceramic magnets having a strength of 3850 Gauss were employed. A first set of upper magnets 30 are oriented such that their magnetic poles are turned North on top and South on the bottom with the South pole contacting the pipe (as best illustrated in FIG. 2). Similarly, a first set of lower magnets are positioned on the underside of the pipe, opposite the first set of upper magnets such that the North pole contacts the pipe and the South pole faces away from the pipe. The foregoing arrangement results in a North-South pole attraction through the pipe. A second set of magnets is flipped over (i.e., the magnetic fields are oppositely oriented from the first set of magnets) and are turned perpendicular to the longitudinal axis of the pipe which results in a disruptive magnetic field that assists in breaking apart the molecular bonds of the fuel. Lastly, a third set of magnets is oriented parallel to the loingitudinal axis of the pipe and with field orientations identical to the first set of magnets. It has been determined that three sets of magnets is effective in treating lighter fuels such as gasoline, liquid natural gas and LPG, for heavier fuels a second group of three sets of magnets may be required.

The magnets are held in place via suitable means, such as with tape or glue. The flux produced by magnets 30 serves to reduce the strength of the bonds within the individual fuel molecules and assists in breaking apart the molecules, thereby enabling the fuel to be more completely oxidized or burned.

Positioned within pipe 26 is a non-sacrificial catalyst 40, which in the preferred embodiment comprises natural quartz crystals, silica or the equivalent thereof. The quartz crystals are substantially rectangular and are of a size which fits within the pipe 26 and are held in place with end caps 28 located at each end of the pipe. The end caps 28 are pressure fit to the internal diameter of the pipe. Of course, other types of end caps, well known to those skilled in the art may be employed with equal efficacy.

Figure 5:
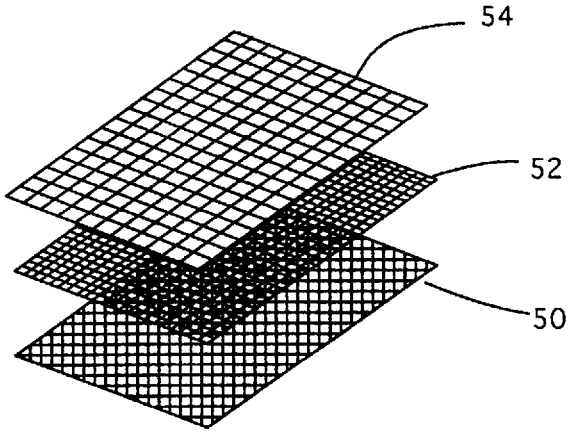
FIG. 5 is a perspective view of the metallic screens as employed in the fuel treatment device according to the present invention.
Figure 6:
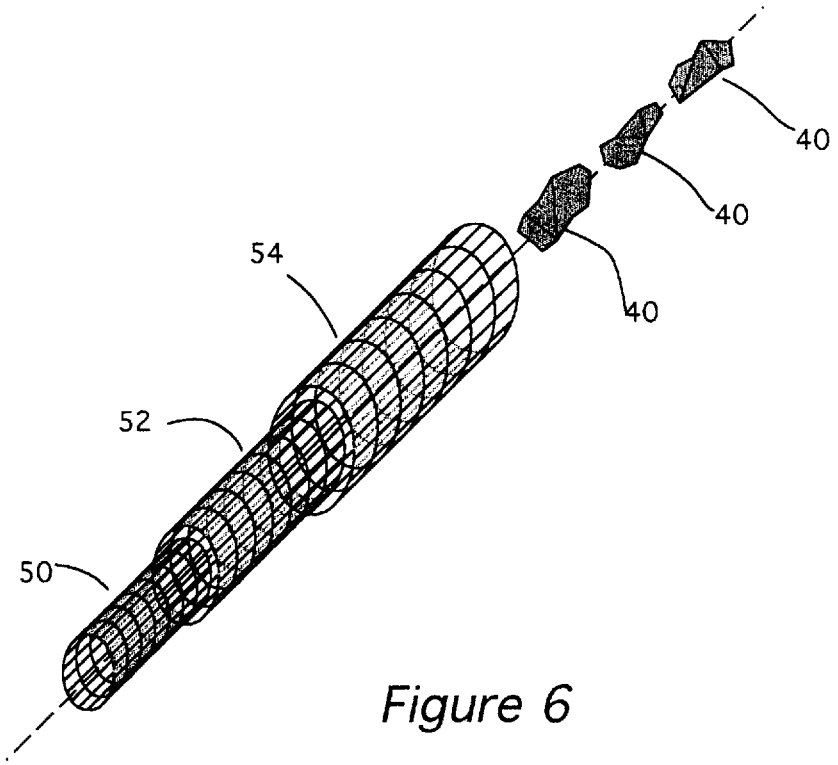
FIG. 6 is an exploded view of the metallic screens and catalytic crystals employed in the fuel treatment device according to the present invention.
Figure 7:
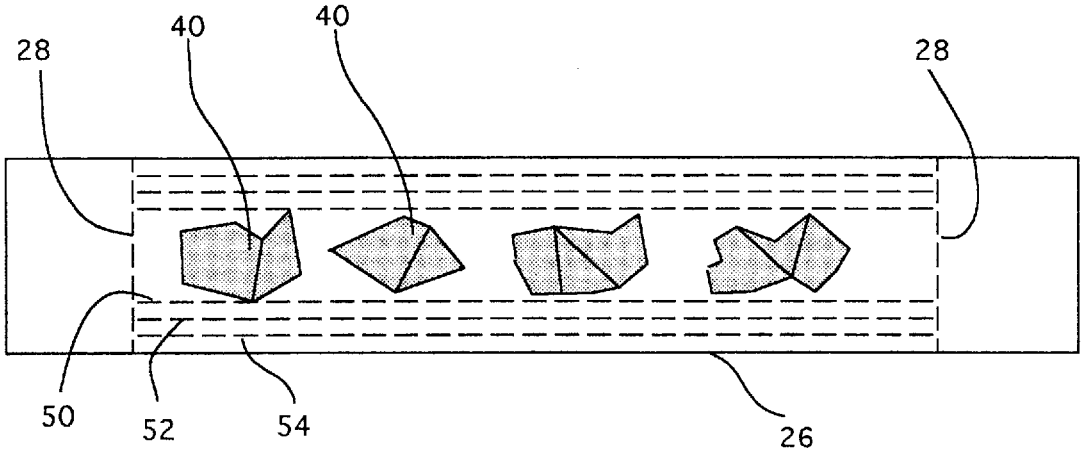
FIG. 7 is a side view, partially broken away, of the fuel treatment device and illustrating the arrangement of metallic screens and catalytic crystals.

In a further embodiment of the invention, best illustrated in FIGS. 5 and 6, a cylindrical metal screen 50 is wrapped so as to surround quartz crystals 40 and the foregoing is inserted within the pipe 26. In the preferred embodiment, the screen is brass. In another embodiment, a plurality of screens of aluminum, galvanized steel and/or brass may be employed, depending on the particular fuel being burned.

For heavier or more dense fuels, such as diesel, an electrical current (either alternating or direct current) may be applied to the pipe such that it becomes electrically charged.

Depending on vehicle type, it may be desireable to apply either a direct current (D/C) or an alternating current (A/C) to the pipe in order to further enhance breaking of the fuel molecule bonds. The output of a direct current (D/C) to alternating current (A/C) inverter may be connected directly to the inlet side of the pipe. Alternatively, if the vehicle is not equipped with an inverter, a wire can be stripped and wrapped around the coil wire and then connected to the pipe in order to supply a 1.5 volt to 3.0 volt supply of A/C voltage. Further, in some cases it may be desireable to apply a D/C voltage directly to the pipe.

A fuel treatment device 10 according to the present invention has been constructed in accordance generally with the foregoing disclosure. Specifically, the device was employed to treat diesel, natural gas and L.P.G. A twelve inch length of pipe was used and 20 magnets were arranged along its length in accordance with FIG. 2. Another device was constructed in accordance with the foregoing description and tested with gasoline engines. In this case, a six inch length of pipe was employed and twelve magnets were arranged along its length, again in accordance with the layout per FIG. 2.

In use, the just described device is connected in-line with the fuel line of a combustion engine or other combustion device such that the fuel flows freely therethrough. If needed, the electrical current is applied thereto. As the catalyst employed is non-sacrificial and the device is entirely passive, it is anticipated that the device will not have to be maintained or exchanged for the life of the engine in which it is installed.

The foregoing embodiments and examples are to be considered illustrative, rather than restrictive of the invention, and those modifications which come within the meaning and range of equivalence of the claims are to be included therein.

That which is claimed is:

1. A device for treating liquid and gaseous fossil fuels which are burned in a combustion apparatus in order to enhance combustion and comprising:

an elongate hollow tube having an inlet end and an outlet end and said tube being adapted to be connected in-line with the engine fuel line proximate to the engine fuel intake;

a plurality of magnets positioned proximate the outer surface of said tube and further, wherein said magnets are mounted alternatingly parallel and perpendicular to the longitudinal axis of said tube; and a non-sacrificial catalyst means positioned within said tube;

whereby the fossil fuel molecules are more completely burned during combustion yielding cleaner exhaust gases and increased fuel efficiency.

2. A device for treating liquid and gaseous fossil fuels according to claim 1 wherein said magnets are mounted about the outer periphery of said tube.

3. A device for treating liquid and gaseous fossil fuels according to claim 2 wherein a first group of magnets is mounted above and below and parralel to the longitudinal axis of said tube such that the magnetic poles are oriented in a first direction, a second group of magnets are mounted above and below said pipe perpendicular to the longitudinal axis of said pipe such that the poles are oriented opposite to those of said first set of magnets and a third set of magnets mounted above and below and parallel to the longitudinal axis of said tube such that the magnetic poles are oriented in said first direction.

4. A device for treating liquid and gaseous fossil fuels according to claim 1 wherein said non-sacrificial catalyst means is selected from the group consisting of quartz and silica.

5. A device for treating liquid and gaseous fossil fuels according to claim 1 further including retention means for maintaining said non-sacrificial catalyst means positioned within said elongate tube.

6. A device for treating liquid and gaseous fossil fuels according to claim 5 wherein said retention means comprises end caps.

7. A device for treating liquid and gaseous fossil fuels according to claim 1 further including a cylindrical metal screen positioned within said tube and wherein said non-sacrificial catalyst means is positioned therewithin.

8. A device for treating liquid and gaseous fossil fuels according to claim 1 further including an electrical force applied to said elongate tube.

9. A device for treating liquid and gaseous fossil fuels which are burned in a combustion apparatus in order to enhance combustion and comprising:

an elongate hollow metal tube having an outlet end and an inlet end and wherein said tube is adapted to be connected in-line with the engine fuel line such that the fuel flows therethrough and further, wherein said tube is connected proximate the engine fuel intake;

a plurality of magnets mounted to the outer surface of said tube and further, wherein said magnets are mounted alternatingly parallel and perpendicular to the longitudinal axis of said tube; and a non-sacrificial catalyst means positioned within said tube;

whereby the fossil fuel molecules are more completely burned during combustion yielding a cleaner exhaust and increased engine efficiency.

10. A device for treating liquid and gaseous fossil fuels according to claim 9 further including a cylindrical metallic screen positioned within said tube and wherein said non-sacrificial catalyst means is positioned therewithin.

11. A device for treating liquid and gaseous fossil fuels according to claim 9 further including a set of nested cylindrical metallic screens positioned within said tube and wherein said non-sacrificial catalyst means is positioned therewithin and further, wherein said screens comprise aluminum, galvanized steel and brass.

* * * * *